United States Patent [19]

Cuzin

[11] Patent Number: 4,808,054

[45] Date of Patent: Feb. 28, 1989

[54] DEVICE FOR PILING UP FLAT PIECES

[75] Inventor: Marc Cuzin, Craponne, France

[73] Assignee: SA Martin, Villeurbanne, France

[21] Appl. No.: 112,894

[22] Filed: Oct. 23, 1987

[30] Foreign Application Priority Data

Oct. 24, 1986 [FR] France ..... 86 15023

[51] Int. Cl.[4] ..... B65G 57/30

[52] U.S. Cl. ..... 414/795; 271/212; 271/224; 414/795.3

[58] Field of Search ..... 271/212, 221, 224; 414/92, 93, 96

[56] References Cited

U.S. PATENT DOCUMENTS

| | | | |
|---|---|---|---|
| 2,111,024 | 3/1938 | Donnellan | 414/92 X |
| 3,022,999 | 2/1962 | Mead | 271/221 X |
| 3,585,909 | 6/1971 | Carrel | 414/92 X |
| 4,425,068 | 1/1984 | Wilson et al. | 414/92 X |

FOREIGN PATENT DOCUMENTS 2087732 12/1971 France .

*Primary Examiner*—Frank E. Werner
*Assistant Examiner*—Janice Krizek

[57] ABSTRACT

A device for piling up flat pieces, such as printed and folded box blanks characterized by a piling station having a comb supporting a front edge of a pile of blanks and a rotating sleeve member having an axially extending groove supporting a rear edge of the pile. New blanks are introduced below the pile by a belt conveyor and the blank is lifted into the pile by front lifting elements engaging the belts of the conveyor to lift the front edge of the blank into the pile and sector elements moving to lift the rear portion of the blank into the pile. The comb is reciprocated out of engagement as the lifting elements lift the front portion into the pile and the sleeve is rotated to present the groove so that the back edge of the blank can move past the sleeve and into the pile.

5 Claims, 7 Drawing Sheets

FIG. 4
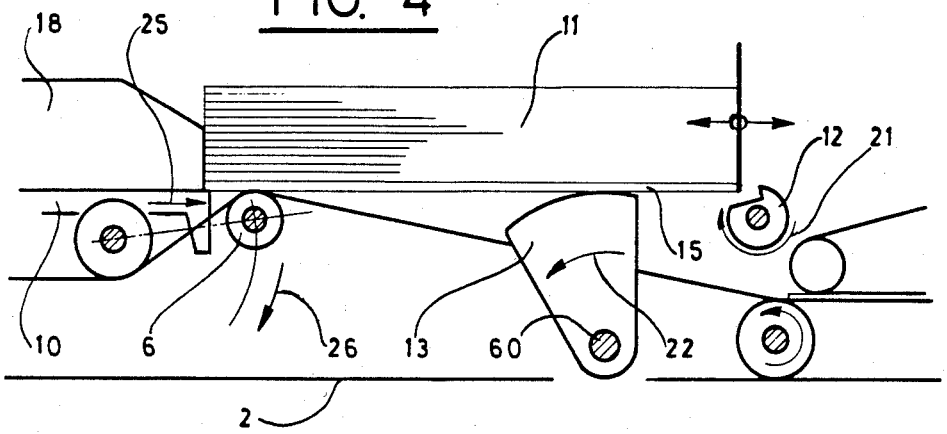
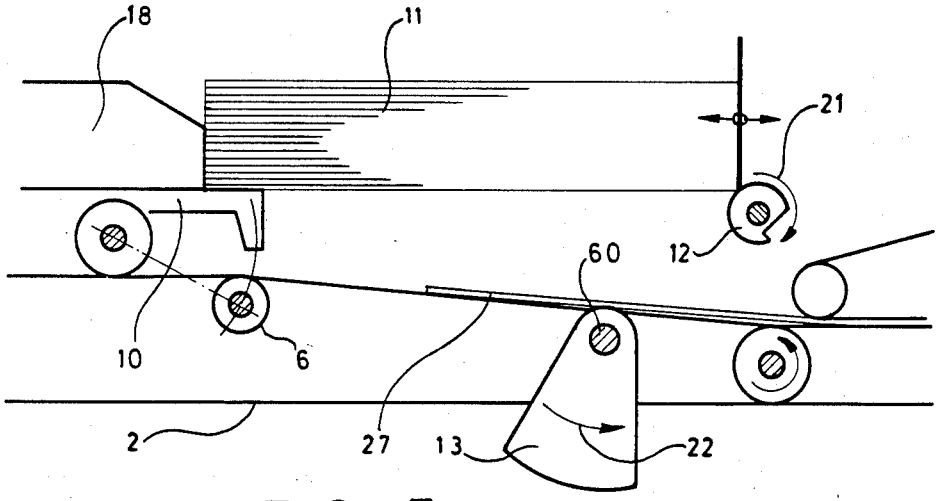
FIG. 5

DEVICE FOR PILING UP FLAT PIECES

BACKGROUND OF THE INVENTION

The present invention is directed to a device for piling up flat pieces, for instance printed and folded box blanks, with a device for transferring the boxes beneath a pile of box blanks already formed in a piling station, which station is provided at least with a front stop and a blank jogging device, an arrangement for supporting the front and rear parts of the pile of blanks that has been formed, and an arrangement for supporting the front and rear part of the box blank being introduced beneath the pile.

Devices of this type are generally used in machines for cutting corrugated box board and are usually located toward the end station just before a bundling station. Among these devices, some are known as system pilings from underneath, because all subsequently folded and printed box blanks are inserted underneath the pack being formed. The upper part of the pack is then regularly forwarded to the bundling station.

French Pat. No. 2 087 732 describes the elements composing a piling device which has the purpose to reduce the friction between the lowest box blank of a pile of blanks and the next box blank being inserted underneath the pile and to reduce the friction between the conveying means and the box blank that is being carried into the piling station. For this purpose, a conveying device shifts the front part of the box blank against the stop, the device operates jointly with rollers situated between its belts in the front area of the box blank to be piled up, as well as with a mechanism consisting of several elements moving with a relative motion in order to support the rear part of the pack and to enable the introduction of the next box blank underneath the pack. The next box blank is then supported by these elements. Such a device has, however, important drawbacks because when all the boxes are piled up, the friction acting on the rollers in the front area of the blanks is only a residual and whereas when a new box blank is introduced underneath the pile, its upper face is rubbed over quite a distance against the lower face of the lowermost blank already in the pack or pile. This rubbing distance is equal to the distance between the rollers and the front stop. This friction may damage the printing on the box blank faces and also has a bad effect on the box blank itself. For example, the friction may jeopardize the adherence of various box panels. In fact, the latter have, at this stage of the operation on the blanks, just been glued and folded and, thus, the friction creates the risk that the glued portions will become detached because of the shearing motion and render these panels unable to stick together any longer. Moreover, the piling of boxes or blanks with irregular cut edges on the panels or with handling and air holes might be subjected to jamming if the boxes are placed in an overlapping arrangement.

SUMMARY OF THE INVENTION

The present invention is proposed to eliminate the above-mentioned drawbacks. It is proposed as a solution for piling up flat pieces, such as folded box blanks, wherein a new piece is introduced underneath an already built-up pile of blanks by reducing, as much as possible, the amount of frictional engagement between the lower box blank of the pile already formed and the blank arriving underneath it.

The main advantage of this invention is to allow the piling up of box blanks with only a slight amount of friction at their ends when they are introduced underneath the pile and, thus, eliminates the risk of damaging by friction or rubbing the printed surfaces and glued parts as well as any contingent jamming.

Other objects and advantages of the present invention will be readily apparent from the following description of the preferred embodiments, the drawings and the claims.

BRIEF DESCRIPTION OF THE DRAWINGS

FIGS. 1–5 schematically show a processing cycle for the device of the present invention, with FIG. 1 showing the introduction of a box blank into the device, FIG. 2 showing the next step as the blank is being moved into the lowermost position, FIG. 3 illustrating the lifting of the blank underneath the pile, FIG. 4 showing the completion of the lifting of the blank up into the pile, and FIG. 5 showing the processing of the next following blank;

DESCRIPTION OF THE PREFERRED EMBODIMENTS

Figure 1:
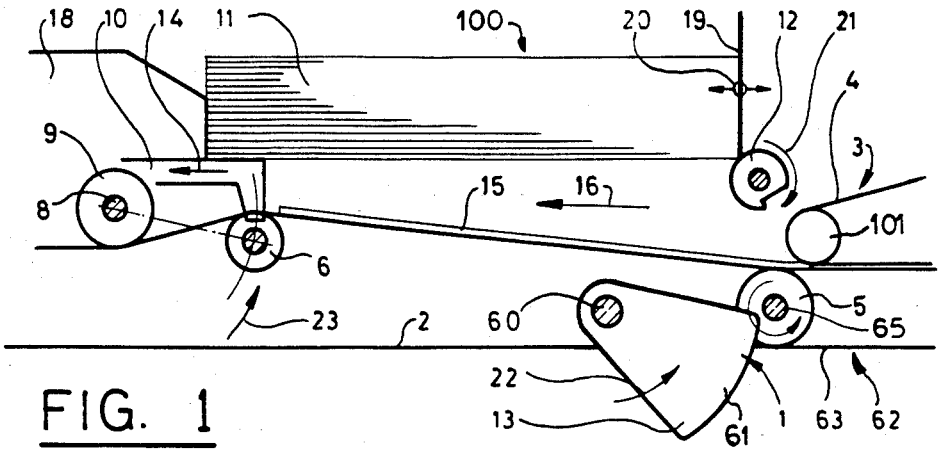

The principles of the present invention are particularly useful in a piling device, generally indicated at 100 in FIG. 1. The device 100 includes a lower conveyor 1 having a plurality of endless belts 2 which are arranged side-by-side and extend from a group of drive pulleys 5 on a drive shaft 65 through tensioning rollers 9 on a shaft 8. In addition, the device 100 has an upper conveyor 3 which has a plurality of endless belts 4 arranged side-by-side, which terminate after passing around rollers 101. In the forward area portion of the piling area, the belts 2 move over lifting elements 6 which pivot around the shaft 8 of the tension rollers 9 in the direction of the arrow 23.

Figure 10:
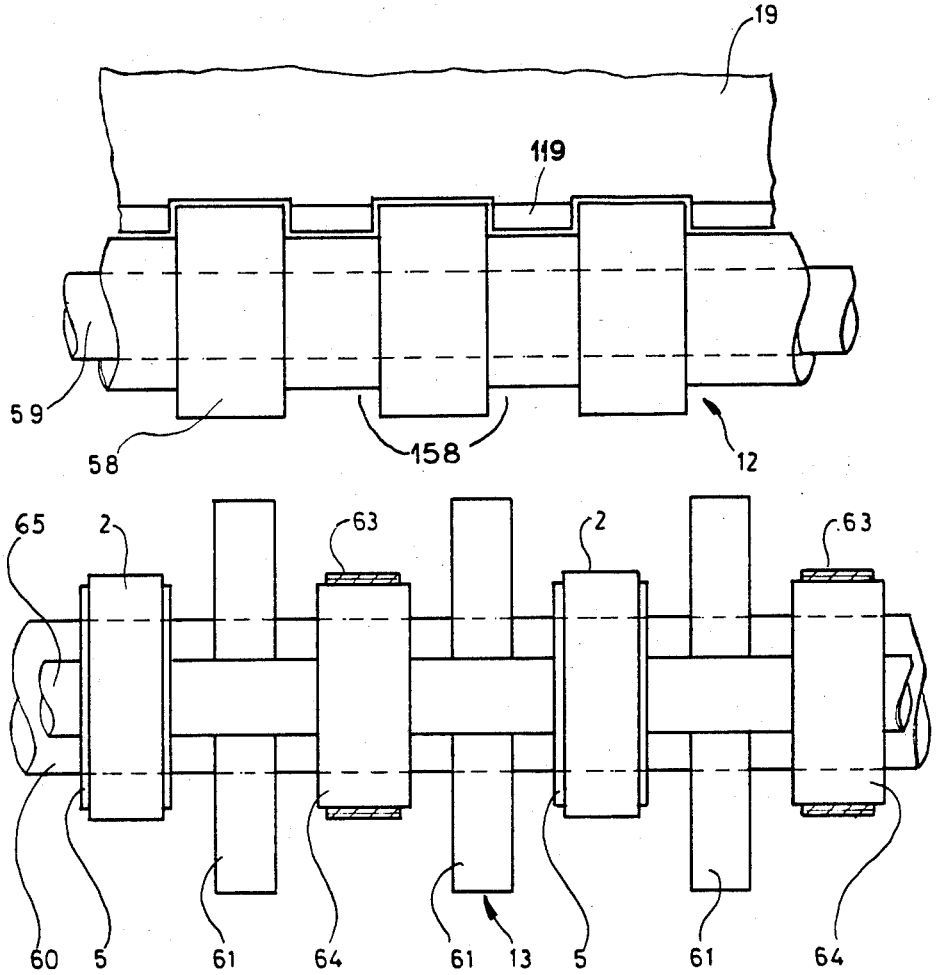
FIG. 10 is a partial end view of the piling station taken from the direction of arrow A of FIG. 7.

To introduce the blanks, such as 15, an introduction conveyor 62, which has a plurality of belts 63 situated side-by-side, cooperates with the upper conveyor 3. As best illustrated in FIG. 10, the belts 63 are supported by drive pulleys 64, which are mounted on the shaft 65 between the drive pulleys 5 for the belts 2. Thus, at the end of the conveyor 62 is the beginning of the lower conveyor 1 of the piling device 100.

Figure 3:
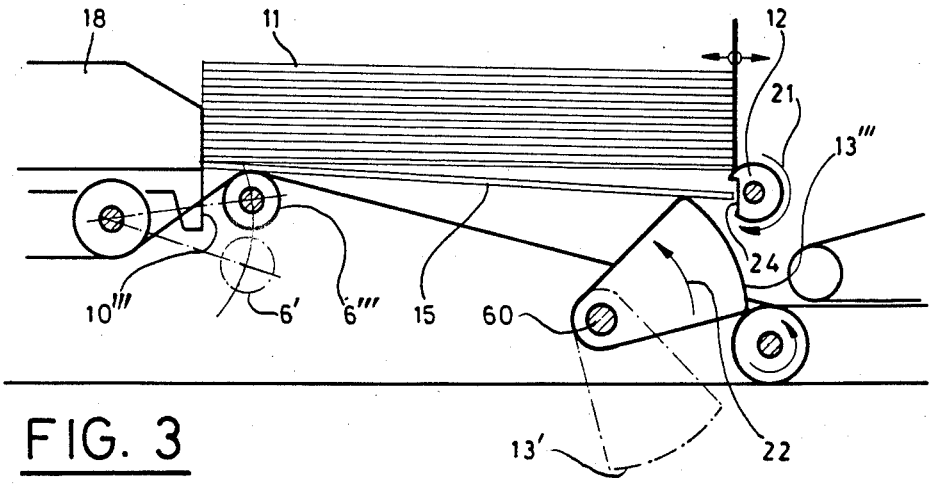

In order to support a pile 11 in the device, the piling device includes an element 10 for supporting a front edge of the pile 11, an element 12 for supporting the rear edge or part of the pile 11, and elements 13 which support the rear part of the box blanks 15 and act to lift the box blank into the pile. The element 10 includes a comb 17 (see FIGS. 6, 8 and 9), which shifts from the extended position illustrated in FIG. 1 in the direction of arrow 14 to a retracted position, which is best illustrated in FIG. 3, and then can be shifted in the direction of arrow 25, as illustrated in FIG. 4, back to the extended or supporting position of FIG. 1 after having been retracted. This shifting, particularly in the direction of arrow 14, is synchronized with the movement of the box blank 15, which is being carried by the conveyor 1 in the direction of arrow 16 into the piling area. The shifting of the comb is also synchronized with the movement or motion of the lifting elements 6, the lifting elements 13, which support the rear part of the blanks, and also the supporting element 12. The elements 13 for supporting the rear part of the blanks 15 consist of a plurality of sectors 61 (see FIGS. 1 and 10), which are arranged side-by-side along a transverse shaft 60. As illustrated, these sectors are positioned so that they can move in between the belts 2 as they rotate with the shaft 60.

The piling station includes a front stop 18 and a device 19 for jogging the pile 11 of blanks. The front stop 18 is adjustably mounted in the frame and can be set with regard to the size of the blanks. The jogging device 19, however, is moved continuously with a reciprocating motion, as indicated by the arrow 20 (FIG. 1).

As illustrated in FIG. 1, at the beginning of the cycle for introducing a box blank 15 into the pile 11, the blank 15 leaves the upper conveyor 3 and the lower conveyor 62 and is then deposited on the lower conveyor 1. The lower conveyor 1 carries the blank into the lifting position. As the leading edge of the blank 15 reaches a predetermined position, the comb 17 starts shifting in the direction of arrow 14 towards a retracted position 10''' (FIG. 3). At the same time, the elements 12 and 13, which support the rear part of the pile 11, and the blank 15 also rotate in the direction of the arrows 21 and 22, and the front lifting element 6 starts to rotate or pivot in the direction of the arrow 23. The motion of all these elements are controlled, for instance, to start with a signal from a detection means which detects the leading edge of the blank 15 entering the piling area. Such a detection means or device can consist of a photocell which will detect the front edge of the blank 15 as it enters the desired position and sends information to a control device which starts the movement and rotation of the various elements. It should be noted that at this point no friction occurs between the blank 15 and the belts 2.

Figure 2:
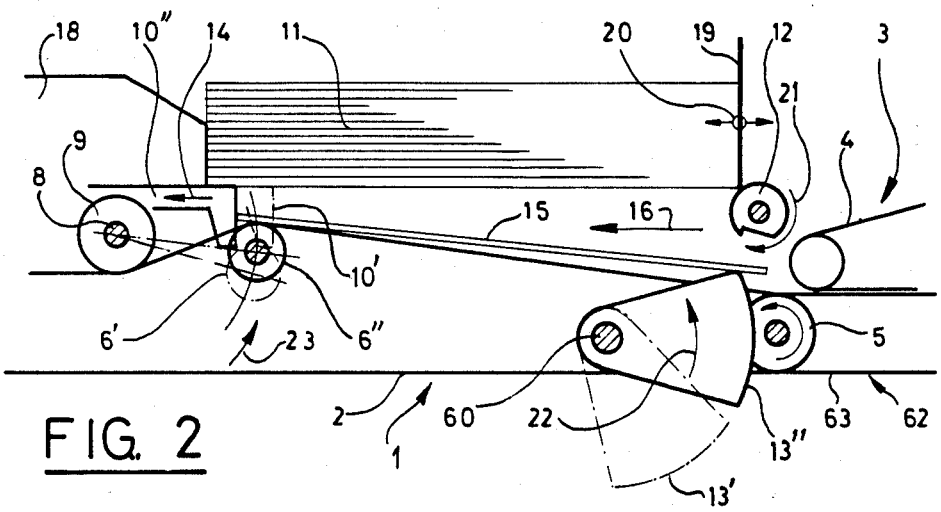

In FIG. 2, the new blank is moving beneath the pile 11. The front edge of this blank 15 is shifted by the belts 2 against the element 10 which supports the front part of the pile. As the blank 15 progressively shifts in the direction of the arrow 16, the element 10 supporting the front part of the pile is shifting from a position 10' shown in broken lines to the position 10''. Simultaneously, the element 13 has rotated from a position 13' to the position 13'' to start to lift the rear part of the blank 15. The element 6 has been lifted from a position 6' to a position 6'' to start to lift the front portion of the blank 15. The element 12, which supports the rear part of the pile 11, has also rotated in the direction of arrow 21. No friction has occurred between the belts 2 and the blank 15, as the motion of the supporting element 10 and the belts 2 are almost equal. Thus, there is no sliding movement between the belts and the blank to cause friction. In addition, the element 13, which supports the rear part of the box, just begins to engage the rear portion and, since it is moving with a peripheral speed equal to the speed of movement of the blank 15 into the device, there isa no slipping or sliding therebetween.

In the next phase of the operation, as illustrated in FIG. 3, the blank 15 has moved completely underneath the pile 11. At this time, the element 6 has been pivoted to lift the front part of the blank 15 to its highest position as the element 6 has moved to the position 6'''. It is noted that the element 10 has been completely retracted to the retracted position 10''', and that the element 13 has moved to a lifting position of 13''' to lift the rear part of the blank almost up to the level of the pile. The support element 12 has moved so that an axially extending groove 24 is positioned to receive the trailing edge of the blank to allow its movement up to and into engagement with the rear of the pile as the element 12 continues to support the pile. This groove allows the lifting of the rear edge of the blank 15 so that it can be shifted beneath the pile 11 without any damage to this edge. For a short while, friction or sliding motion will occur between the belts 2 and the blank 15. However, due to the configuration of the belts because of the lifting elements 6, and the position of the supporting element 10, the area of contact between the belts and the blanks is extremely short so that the area for potentional damage has been limited. It is also noted that some relative movement between the lifting elements 13 and the rear of the box will occur as the edge of each of the segments begins to move along the blank.

The completion of the lifting of the blank 15 into the pile is illustrated in FIG. 4. At this stage, the lifting element 13 had moved to its vertical upper position and holds the rear portion of the blank 15, as well as the rear portion of the pile, as the element 12 continues to rotate in the direction of the arrow 21 to move the groove out of a position immediately below the end of the pile so that the pile can again rest on a peripheral surface of the element 12, as illustrated in FIG. 5. At the same time, the support element 10 is shifted in the direction of arrow 25 from the retracted position of FIG. 3 towards the extended position so that it again supports the leading edge of the pile 11 immediately adjacent the stop 18. This enables each lifting element 6 to descend from its uppermost position by pivoting in the direction of arrow 26 to the lowermost position. As each element 6 reaches the lowermost position 6 and the lifting element or support elements 13 have pivoting around to a lowermost position, such as illustrated in FIG. 5, another blank 27 is carried by the conveyor 2 into a position similar to that shown by the blank 15 in FIG. 1 to repeat the operation.

It should be noted that between the stages illustrated in FIGS. 3 and 4, the friction of the belts 2 on the blanks 15 has been eliminated and that only the element 13, which engages a rear portion of the blanks 15, is still in contact with it until the element 12 is in the position to support the rear edge of the pile 11, as illustrated in FIG. 5. The elements 12 and 13 move in a continuous rotation synchronized with the linear reciprocal motion of the element 10 and the swinging and lifting motion of the elements 6. These motions of the elements 10 and the lifting element 6 can be obtained with well-known devices, including cams and levers which are interconnected by various gear trains and/or drives.

Figure 6:
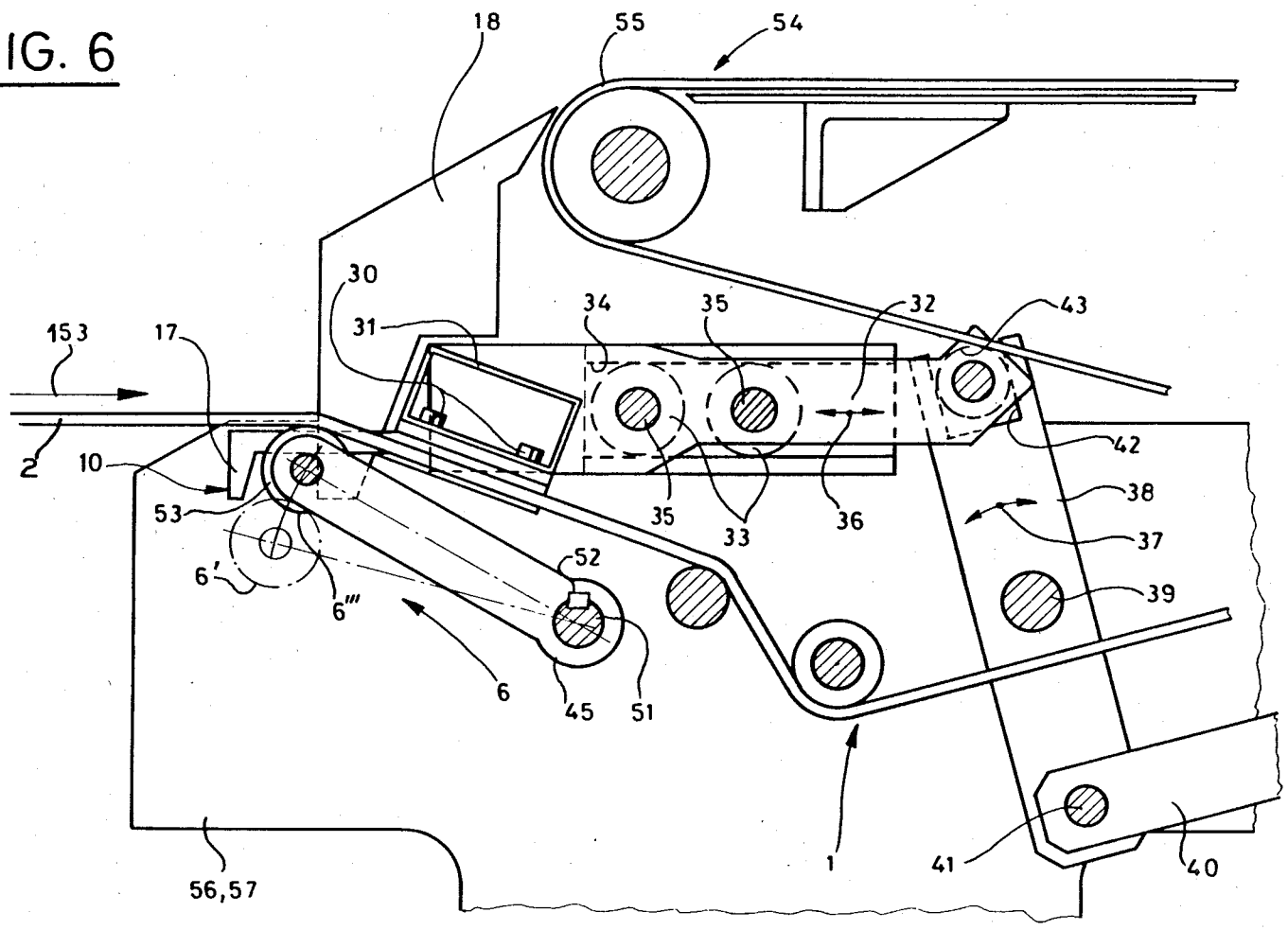
FIG. 6 is a cross sectional view with portions in elevation for purposes of illustration of an arrangement for supporting the front end of a pile and also for moving the front end of a blank being inserted beneath the pile up into the pile.
Figure 8:
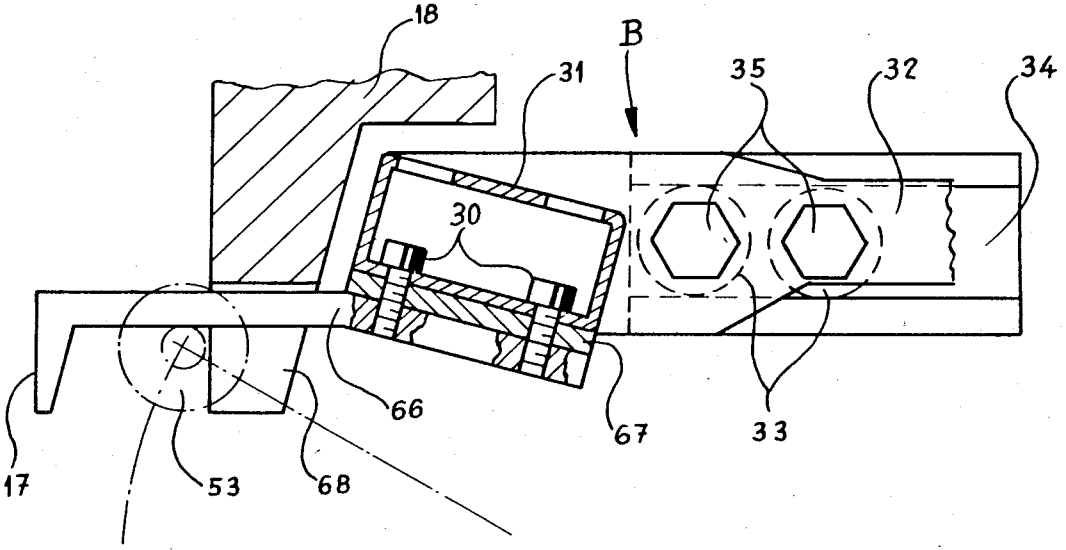
FIG. 8 is an enlarged partial cross sectional view with portions removed for purposes of illustration of portions of the supporting device for the front end of the pile, which are illustrated in FIG. 6.
Figure 9:
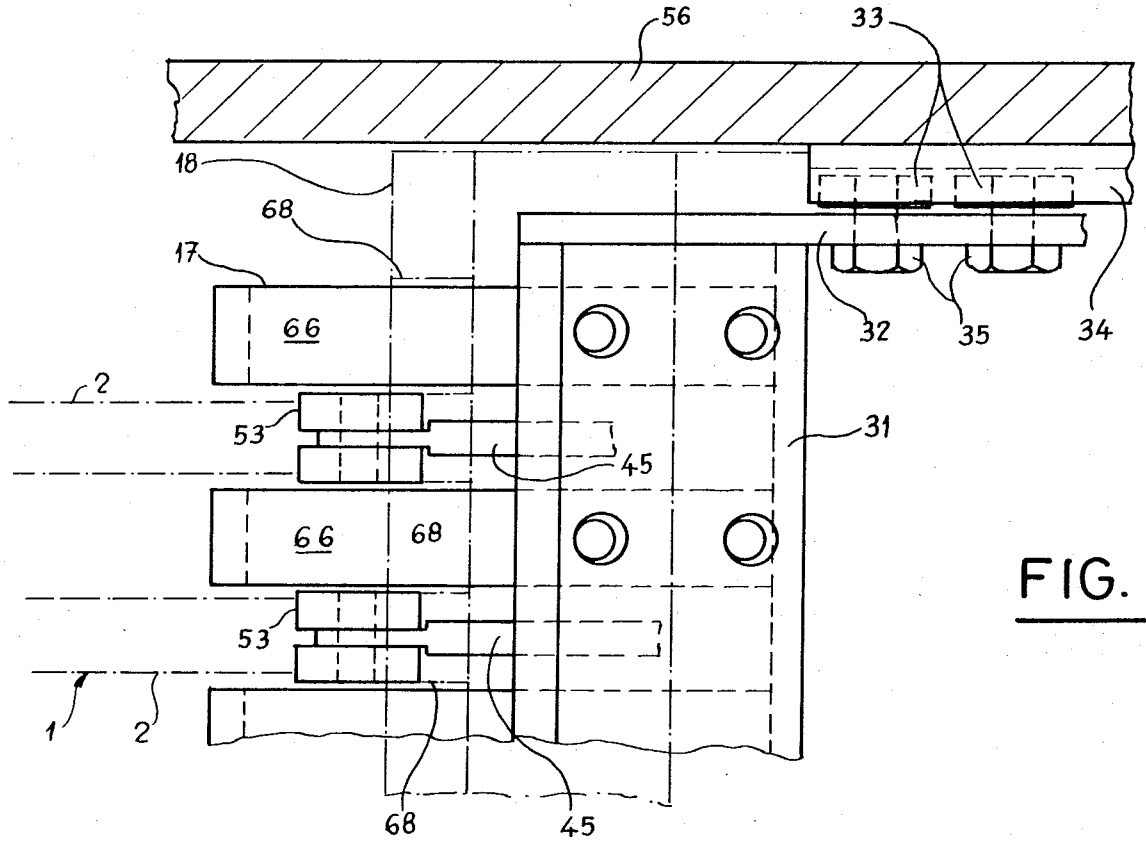
FIG. 9 is a partial plan view with portions removed for purposes of illustration taken in the direction of arrow B in FIG. 8.

The actual structure of the support element 10, which is formed by the comb 17, is best illustrated in FIGS. 6, 8 and 9. As illustrated, the comb 17 is mounted with screws 30 on a tubular cross bar or member 31 which has its ends connected with lever or members 32. Each lever 32 is provided with two rollers 33 which are received in slideways 34 formed on the two lateral frame members 56 and 57. The actual arrangement of the rollers 33 in the slideway 34 of the frame member 56 is best illustrated in FIG. 9. It should be noted that the rollers 33 are mounted on the lever by means of studs or bolts 35.

The reciprocal motion of the comb 17 in the direction of arrow 36 is generated by a cam acting on a rod 40. The cam transmits a reciprocal movement to the rod 40, which is connected by a pin or axle 41 to a lever 38, which is mounted for pivotal movement on a shaft 39. The one end of the lever 38 is provided with a slideway 42 which receives a roller 43 which is secured on the end of the lever 32.

As illustrated in FIG. 6, the lifting element 6 comprises set-up levers 45 arranged side-by-side along the axial width of the piling device. The levers 45 are connected at one end to a transverse shaft 51 by means of a key 52. The other ends of each of the levers 45 are provided with twin rollers 53, which are best illustrated in FIG. 9. The shaft 51 will oscillate and, thus, shift the twin rollers 53 from the position, such as 6' to 6''', as illustrated in FIGS. 2 and 3. This oscillation is generated by a conventional cam or lever arrangement (not illustrated).

As best illustrated in FIG. 9, the levers 45 are set so that the twin rollers 53 are aligned so as to be able to support each of the belts 2 of the conveyor 1. The blanks arriving in the pile area according to the direction of arrow 153 (FIG. 6) are lifted into the pile. The top of the pile is then removed by a conveyor 54 which has a plurality of belts 55 arranged side-by-side along the width of the front stop 18. As mentioned hereinbefore, all of these elements are arranged between two lateral frame elements, such as 56 and 57, which also will support the cam and lever controls for the actuation of the lifting elements 6 and the reciprocation of the comb 17.

As best illustrated in FIG. 8, the comb 17 can be formed by a plurality of fingers 66, which are secured by sceew side-by-side along the tubular cross bar 31. The fingers 66 are mounted on a reinforcing element, such as 67, which is welded to a lower part of the tubular cross part 31. The stop 18, as illustrated along its lower edge, is provided with openings, such as 68, to provide space for the fingers 66 to extend through.

Figure 7:
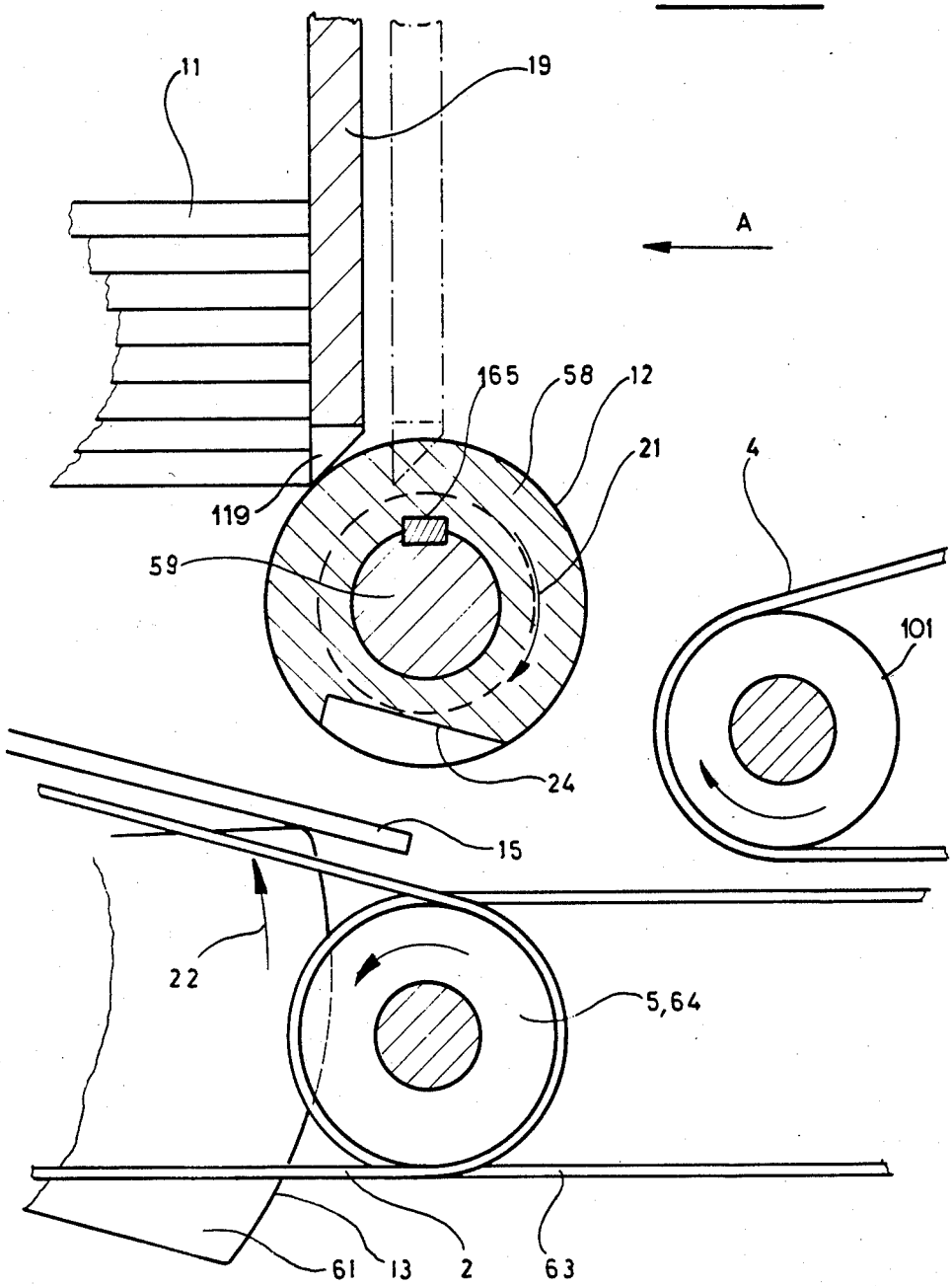
FIG. 7 is a cross sectional view of a rear portion of the pile showing the arrangement for supporting the rear edge of the pile.

The structure of the rear supporting element 12 is best illustrated in FIGS. 7 and 10. The element 12 has a sleeve 58 on a transverse shaft 59, which shaft is continuously rotating in the direction of arrow 21. This sleeve has an axial groove 24, which is machined along its whole axial length. This groove is to receive the rear edge of the blank 15 when it is introduced underneath the lower box of the pile 11. In addition, the sleeve 58 has been machined with annular grooves 158 (FIG. 10), which provide space for receiving teeth or projections 119 of the plate forming the jogging device 19. The sleeve 58 is mounted on a transverse shaft 59 by means of a key or pin 68 (FIG. 7) and can be prevented from lateral movement by a conventional manner, such as with stop rings or thrust bearings.

Although various minor modifications may be suggested by those versed in the art, it should be understood that I wish to embody within the scope of the patent granted hereon all such modifications as reasonably and properly come within the scope of my contribution to the art.

I claim:

1. In a device for piling up flat pieces, for example printed and folded box blanks, said device comprising a belt conveyor for introducing a box blank underneath a pile of box blanks which pile is already formed in a piling station, said piling station having a front stop and one blank jogging device, means for supporting the front and rear parts of a pile already formed in the piling station and means for supporting the front part and rear part of a new box blank being introduced beneath the pile, the improvements comprising the means for supporting the front part of the pile comprising a comb mounted by means for reciprocal movement between an extended position supporting the front part of the pile and a retracted position removed from beneath the front part of the pile, the means for supporting the rear part of the pile comprising an outer surface of a sleeve mounted on a shaft for rotation, said sleeve having an axially extending groove in the outer surface, the means for supporting the front part of a new blank to be raised into the pile including lifting elements acting on a lower face of belts conveying the blank into the piling station to lift a leading edge of the blank as it approaches the front part of the pile, the means for supporting the rear part of the blank being introduced into the pile including a plurality of sector elements mounted on a transverse shaft moving in continuous rotation to raise a rear part of the blank into the pile, said means being synchronized so that as the comb is shifted to the retracted position, the lifting elements and sector elements are lifting the blank into the raised position and the sleeve presents the axially extending groove to allow passage of a trailing edge of the blank as the blank is being lifted by the sector elements into the pile of blanks.

2. In a device for piling up flat pieces according to claim 1, wherein the means for reciprocal movement include the comb being mounted on a transversely extending member, the ends of said member being provided with rollers received in sideways provided on inner faces of lateral frame members of the device, each of the ends being connected with a pivotal lever moving to cause reciprocation of the comb, and said sleeve having annular grooves to sub-divide the sleeve into spaced annular supporting surfaces interrupted by the axially extending groove.

3. In a device for piling up flat pieces according to claim 2, wherein each of the lifting elements comprises a lever mounted on a rotatable shaft, said lever is provided at one end with twin rollers contacting a lower surface of a belt of the conveyor.

4. In a device according to claim 3, wherein the levers are mounted in a space extending between fingers of the comb and move above the fingers as they lift the front part of the blank into the pile.

5. In a device acording to claim 2, wherein the sector elements are mounted side-by-side between the belts of the conveyor transporting the box blanks into the piling station and moved through said belts as they lift the rear part of the blank into the pile.

* * * * *